US011125140B2

(12) United States Patent
Endo

(10) Patent No.: US 11,125,140 B2
(45) Date of Patent: Sep. 21, 2021

(54) ENGINE COOLING STRUCTURE

(71) Applicant: TOYOTA JIDOSHA KABUSHIKI KAISHA, Toyota (JP)

(72) Inventor: Yoshiki Endo, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/880,442

(22) Filed: May 21, 2020

(65) Prior Publication Data

US 2020/0392888 A1 Dec. 17, 2020

(30) Foreign Application Priority Data

Jun. 14, 2019 (JP) ..... 2019-111002

(51) Int. Cl.

| | |
|---|---|
| ***F01P 3/02*** | (2006.01) |
| ***F02F 1/40*** | (2006.01) |
| ***F02F 11/00*** | (2006.01) |
| ***F01P 5/12*** | (2006.01) |
| ***F01P 7/14*** | (2006.01) |

(52) U.S. Cl.

CPC *F01P 3/02* (2013.01); *F01P 5/12* (2013.01); *F01P 7/14* (2013.01); *F02F 1/40* (2013.01); *F02F 11/002* (2013.01); *F01P 2003/024* (2013.01); *F01P 2005/125* (2013.01); *F01P 2007/146* (2013.01); *F01P 2025/06* (2013.01)

(58) Field of Classification Search

CPC ..... F01P 3/02; F01P 7/14; F01P 5/12; F01P 2003/024; F01P 2005/125; F01P 2025/06; F01P 2007/146; F02F 11/002; F02F 1/40; F16J 15/064; F16J 15/122

See application file for complete search history.

(56) References Cited

U.S. PATENT DOCUMENTS

| | | | | |
|---|---|---|---|---|
| 5,022,662 | A * | 6/1991 | Yasui | F01P 3/02 277/599 |
| 6,305,420 | B1 * | 10/2001 | Atkinson | F01M 1/16 123/196 R |
| 7,137,361 | B2 * | 11/2006 | Vialard | F01P 7/14 123/41.08 |
| 9,897,208 | B2 * | 2/2018 | Hoehe | F16J 15/064 |
| 2003/0150438 | A1 * | 8/2003 | Nakamizo | F01M 13/0011 123/572 |
| 2005/0095157 | A1 * | 5/2005 | Seo | F04B 39/1073 417/565 |

(Continued)

FOREIGN PATENT DOCUMENTS

| | | | | |
|---|---|---|---|---|
| DE | 102004031458 | A1 * | 1/2006 | F16J 15/064 |
| DE | 102004049292 | A1 * | 4/2006 | F16J 15/064 |
| WO | WO 2011/067830 | A1 | 6/2011 | |

*Primary Examiner* — Hung Q Nguyen

(74) *Attorney, Agent, or Firm* — Oblon, McClelland, Maier & Neustadt, L.L.P.

(57) ABSTRACT

An engine cooling structure includes a head gasket sitting between a bottom surface of a cylinder head and a top surface of a cylinder block, a connection water passage for coolant that connects an in-head water jacket and an in-block water jacket to each other, and a reed valve that opens and closes in correspondence with a differential pressure of coolant in the in-head water jacket and coolant in the in-block water jacket. The reed valve includes a reed portion arranged integrally with a part of the head gasket corresponding to the connection water passage.

6 Claims, 3 Drawing Sheets

(56) References Cited

U.S. PATENT DOCUMENTS

| | | | | |
|---|---|---|---|---|
| 2005/0217615 | A1* | 10/2005 | Matsutani | F01P 9/00 123/41.74 |
| 2005/0279295 | A1* | 12/2005 | Vialard | F16J 15/0818 123/41.74 |
| 2006/0011151 | A1* | 1/2006 | Huter | F01P 3/02 123/41.29 |
| 2008/0223349 | A1* | 9/2008 | Uenomaya | F02B 25/22 123/65 V |
| 2012/0234267 | A1 | 9/2012 | Takahashi | |
| 2013/0333658 | A1* | 12/2013 | Yamamoto | F02F 1/10 123/195 R |
| 2014/0283763 | A1* | 9/2014 | Wakamoto | F02F 1/36 123/41.01 |
| 2015/0345364 | A1* | 12/2015 | Hutchins | F16J 15/0825 123/41.08 |
| 2019/0211930 | A1* | 7/2019 | Pendzialek | F16K 15/144 |

* cited by examiner

ENGINE COOLING STRUCTURE

BACKGROUND

1. Field

The following description relates to an engine cooling structure.

2. Description of Related Art

A water-cooled engine cylinder head internally includes an in-head water jacket as a passage for coolant, and a cylinder block internally includes an in-block water jacket as a passage for coolant. Coolant circulates between the in-head and in-block water jackets and a radiator to cool the cylinder head and the cylinder block.

International Publication No. 2011/067830 discloses a typical engine cooling structure including a circulation circuit for coolant. The circulation circuit includes an in-head water jacket and an in-block water jacket arranged in parallel to each other. The circulation circuit also includes a flow rate control valve that regulates the flow rate of coolant in the in-head water jacket. In the cooling structure, in order to improve the thermal efficiency of the engine, the flow rate control valve is controlled in correspondence with the operating state of the engine.

In the typical engine cooling structure, the flow rate of coolant in the in-block water jacket and the flow rate of coolant in the in-head water jacket can be regulated individually. However, this structure needs, for example, a flow rate control valve and an actuator that drives the flow rate control valve. This will increase the manufacturing cost.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

To achieve the above-described problem, an engine cooling structure according to a first aspect of the present disclosure includes a head gasket sitting between a bottom surface of a cylinder head and a top surface of a cylinder block, an in-head water jacket in the cylinder head, an in-block water jacket in the cylinder block, a connection water passage for coolant that extends through the head gasket to connect the in-head water jacket and the in-block water jacket to each other, and a reed valve that opens and closes in correspondence with a differential pressure of coolant in the in-head water jacket and coolant in the in-block water jacket. The reed valve includes a reed portion arranged integrally with a part of the head gasket corresponding to the connection water passage.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

An engine cooling structure according to an embodiment of the present disclosure will now be described in detail with reference to FIGS. 1 to 8.

Figure 1:
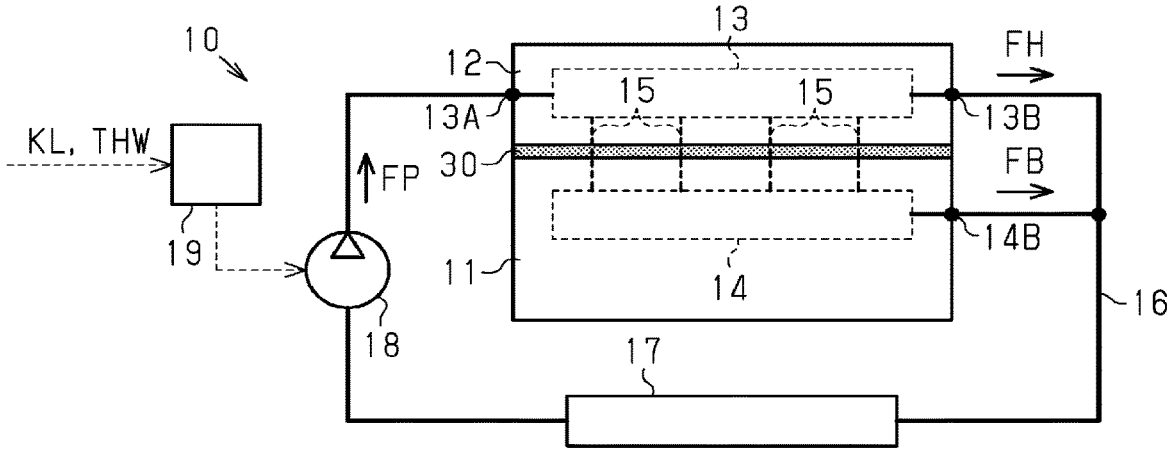
FIG. 1 is a schematic diagram showing the entire configuration of an engine cooling structure.

As shown in FIG. 1, an engine 10 includes a cylinder block 11 and a cylinder head 12. The cylinder block 11 and the cylinder head 12 are fastened to each other with a head gasket 30 sitting between a top surface of the cylinder block 11 and a bottom surface of the cylinder head 12. The engine 10 is an inline-four engine.

Each of the cylinder block 11 and the cylinder head 12 internally includes a water jacket serving as a passage for coolant. In the following description, the water jacket in the cylinder head 12 will be referred to as the in-head water jacket 13 and the water jacket in the cylinder block 11 will be referred to as the in-block water jacket 14. Further, the engine 10 includes twelve connection water passages 15. The connection water passages 15 extend through the cylinder head 12, the head gasket 30, and the cylinder block 11 to connect the in-head water jacket 13 and the in-block water jacket 14 to each other.

The cylinder head 12 includes an inflow port 13A through which coolant flows from the outside into the in-head water jacket 13 and a discharge port 13B through which coolant is discharged from the in-head water jacket 13 to the outside. The cylinder block 11 includes a discharge port 14B through which coolant is discharged from the in-block water jacket 14 to the outside. The cylinder block 11 does not include an inflow port through which coolant flows from the outside into the in-block water jacket 14.

The engine cooling structure includes a coolant circuit 16 through which coolant circulates. The outer side of the cylinder block 11 and the cylinder head 12 in the coolant circuit 16 is provided with a radiator 17 and an electric water pump 18. The radiator 17 cools coolant through the exchange of heat with air. The electric water pump 18 pressurizes and discharges coolant. The operation of the electric water pump 18 is controlled by an electronic control unit 19 for engine control. The electronic control unit 19 uses, for example, an engine load KL and a coolant temperature THW to control a pump discharge flow rate FP, which is the flow rate of coolant discharged by the water pump 18. The electronic control unit 19 corresponds to a pump control unit.

The coolant circuit 16 includes, as a path for coolant, a mainstream path and a sub-stream path. The mainstream path is configured such that the coolant discharged from the water pump 18 flows through the inflow port 13A, the in-head water jacket 13, the discharge port 13B, and the radiator 17 in this order and returns to the water pump 18. The sub-stream path diverts from the main circuit of the in-head water jacket 13. The sub-stream path is configured such that the coolant flows through the connection water passages 15, the in-block water jacket 14, and the discharge port 14B and merges with the coolant in the main circuit between the discharge port 13B and the radiator 17.

Figure 2:
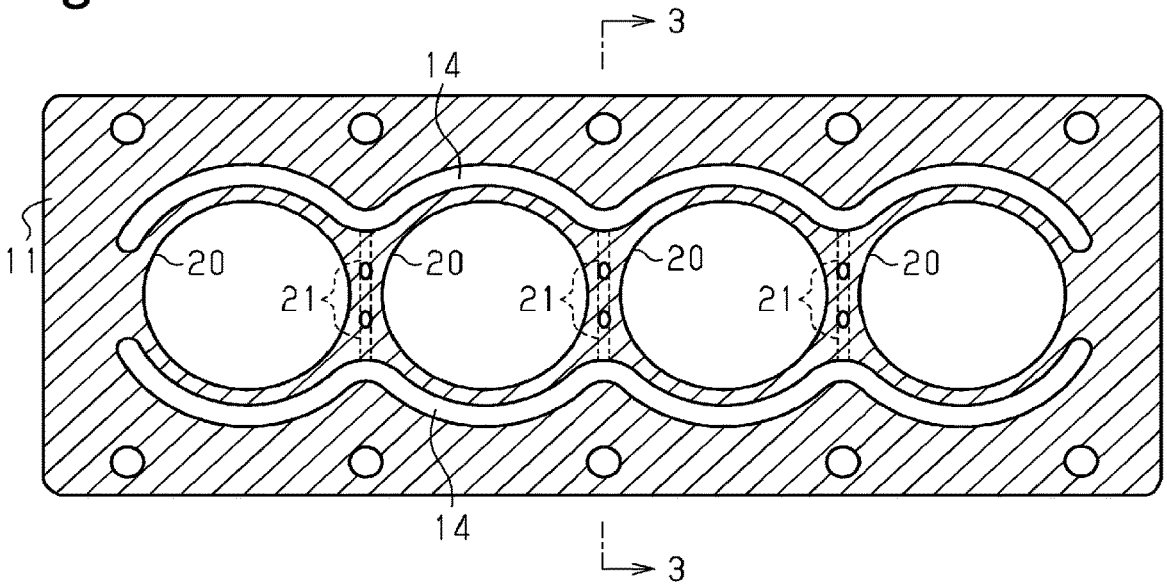
FIG. 2 is a cross-sectional view taken along line 2-2 in FIG. 3.
Figure 3:
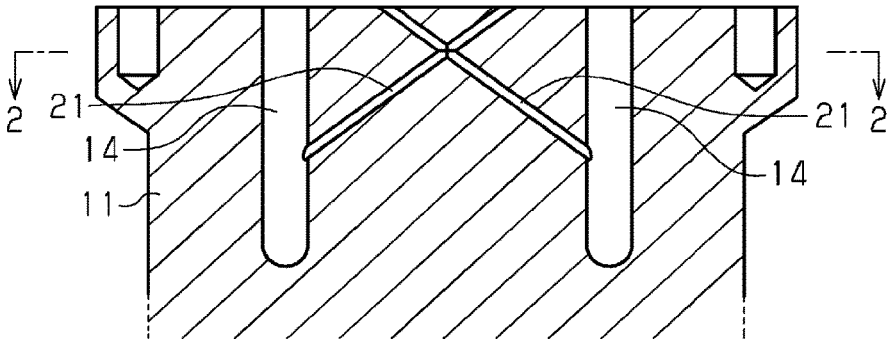
FIG. 3 is a cross-sectional view taken along line 3-3 in FIG. 2.

As shown in FIG. 2, the cylinder block 11 includes four cylinder bores 20 arranged in series. The cylinder block 11 is of a siamesed cylinder type in which the in-block water jacket 14 does not extend through parts between the cylinder bores 20. As shown in FIGS. 2 and 3, inter-bore water passages 21 are arranged between adjacent ones of the cylinder bores 20 in the cylinder block 11. The inter-bore water passages 21 extend from the top surface of the cylinder block 11 through the parts between the cylinder bores 20 and connect to the in-block water jacket 14. In the following description, the portions between adjacent ones of the cylinder bore 20 in the cylinder block 11 are referred to as the inter-bore portions. Each inter-bore portion of the cylinder block 11 includes two inter-bore water passages 21.

Figure 4:
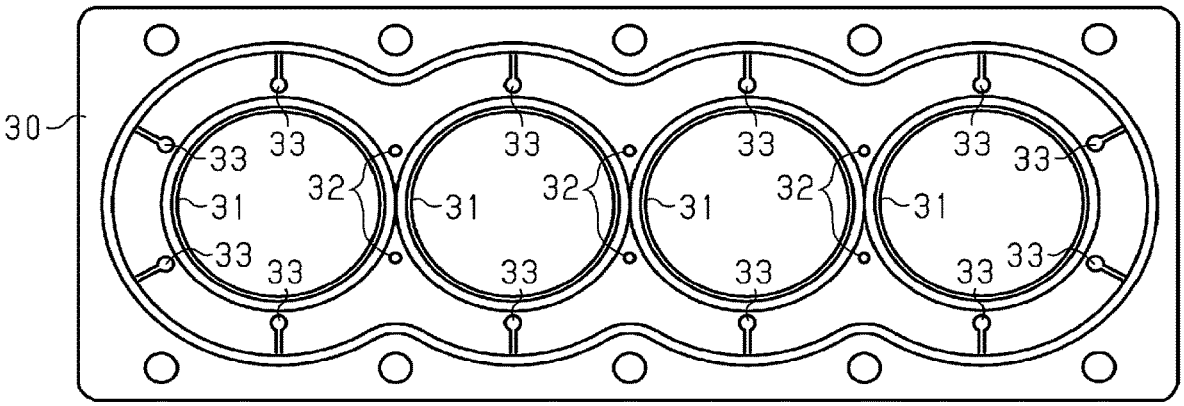
FIG. 4 is a plan view of the head gasket.

As shown in FIG. 4, the head gasket 30 includes four boreholes 31 that are arranged in series and respectively correspond to the four cylinder bores 20. Further, water passage holes 32 are arranged between adjacent ones of the boreholes 31 in the head gasket 30. The water passage holes 32 connect to the openings of the inter-bore water passages 21 on the top surface of the cylinder block 11. In addition, multiple reed portions 33 are arranged around the row of the boreholes 31 in the head gasket 30. The reed portions 33 are arranged at parts corresponding to the connection water passages 15. Water passages connecting to the in-head water jacket 13 are arranged immediately above the water passage holes 32 in the bottom surface of the cylinder head 12. This causes coolant to flow from the in-head water jacket 13 through the inter-bore water passages 21 into the in-block water jacket 14.

Figure 5:
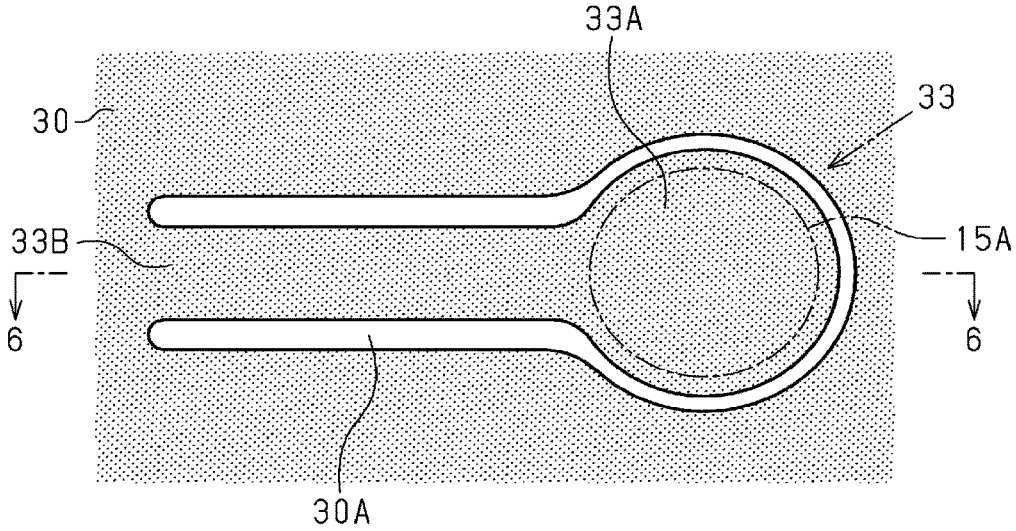
FIG. 5 is a plan view of the reed portion.

As shown in FIG. 5, the reed portion 33 is configured by cutting a groove 30A into the head gasket 30. The first end of the reed portion 33 is a fixed end 33B where the groove 30A is not cut out. The second end of the reed portion 33 is a circular valve member 33A.

Figure 6:
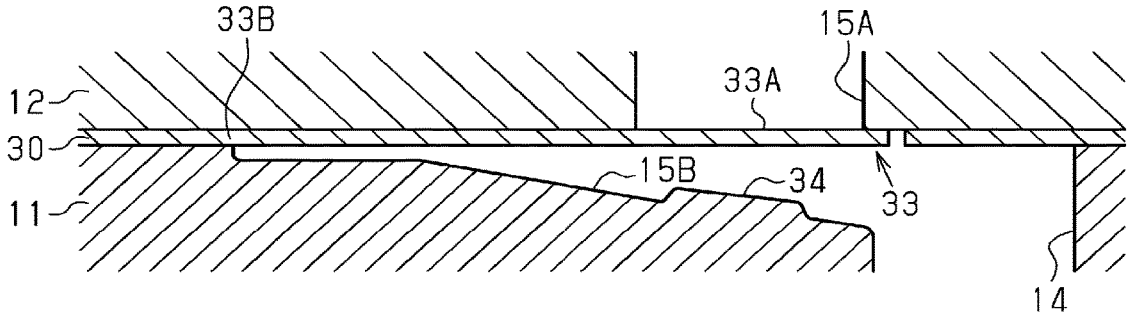
FIG. 6 is a cross-sectional view taken along line 6-6 in FIG. 5 when the reed portion is closed.

As shown in FIG. 6, the valve member 33A is arranged so as to block an opening 15A in the bottom surface of the cylinder head 12 in the connection water passage 15. A recess 15B is arranged immediately below the reed portion 33 in the top surface of the cylinder block 11. The bottom surface of the recess 15B is an inclined surface. The depth of the recess 15B increases from a portion corresponding to the fixed end 33B of the reed portion 33 toward a portion corresponding to the valve member 33A. The recess 15B connects to the in-block water jacket 14 at a portion where the depth of the recess 15B is the maximum. The recess 15B configures a portion of the connection water passage 15 in the cylinder block 11. A projecting valve seat 34 is arranged immediately below the valve member 33A of the reed portion 33 in the bottom surface of the recess 15B.

Figure 7:
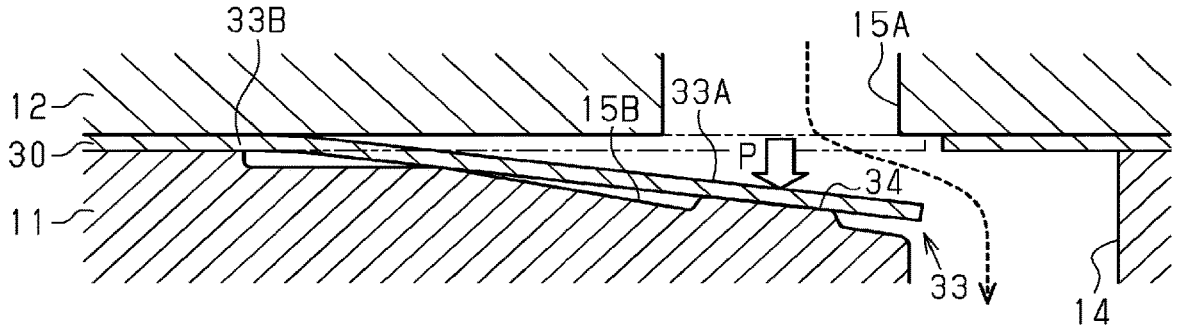
FIG. 7 is a cross-sectional view taken along line 6-6 in FIG. 5 when the reed portion is open.

When external force is not applied to the reed portion 33, the valve member 33A blocks the opening 15A in the bottom surface of the cylinder head 12 in the connection water passage 15. This closes the reed portion 33 to stop the circulation of coolant between the in-head water jacket 13 and the in-block water jacket 14 through the connection water passage 15. In contrast, as shown in FIG. 7, when pressure P having a certain magnitude or greater acting from the cylinder head 12 toward the cylinder block 11 is applied to the valve member 33A, the reed portion 33 is elastically deformed such that the valve member 33A is separated from the opening 15A and pushed down toward the valve seat 34. This opens the reed portion 33 to allow the circulation of coolant between the in-head water jacket 13 and the in-block water jacket 14 through the connection water passage 15. Thus, the above-described engine cooling structure is configured such that the reed portion 33 of a reed valve arranged integrally with the head gasket 30 allows the flow of coolant from the in-head water jacket 13 toward the in-block water jacket 14 in the connection water passage 15 and stops the flow of the coolant in the opposite direction.

In the above-described engine cooling structure, the electric water pump 18 is employed. Further, the electronic control unit 19 controls the pump discharge flow rate FP, which is the flow rate of coolant discharged by the water pump 18. In addition, the coolant discharged by the water pump 18 is first drawn through the inflow port 13A into the in-head water jacket 13. Additionally, the valve member 33A of the reed portion 33 receives, as external force, the differential pressure of the coolant in the in-head water jacket 13 and the coolant in the in-block water jacket 14.

Figure 8:
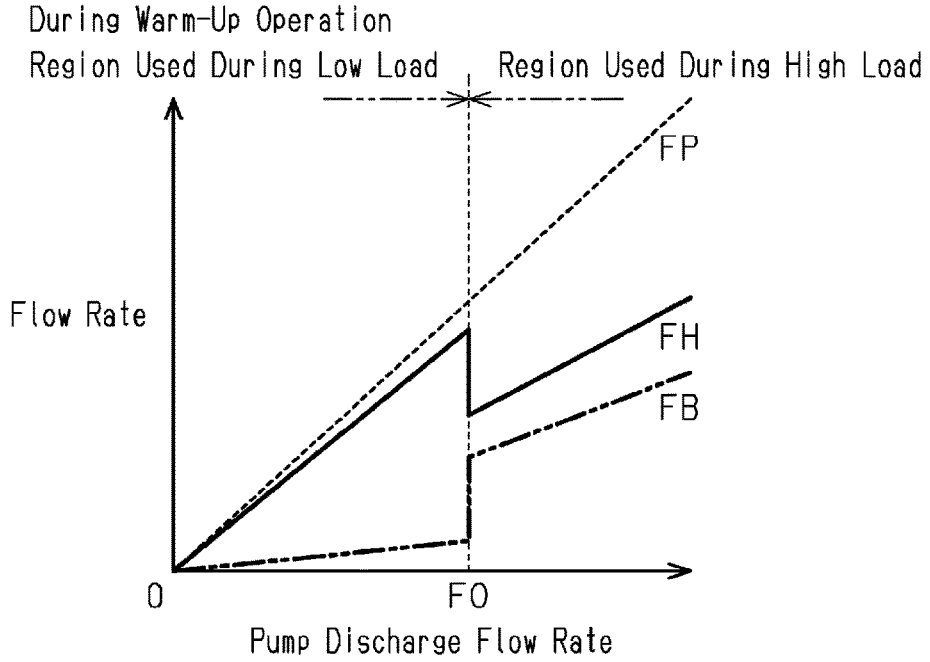
FIG. 8 is a graph indicating the relationship of the pump discharge flow rate of coolant with a head discharge flow rate and a block discharge flow rate.

FIG. 8 shows the relationship of the pump discharge flow rate FP with a block discharge flow rate FB and a head discharge flow rate FH. The block discharge flow rate FB is the flow rate of coolant that passes through the in-block water jacket 14 and flows out of the discharge port 14B. The head discharge flow rate FH is the flow rate of coolant that passes through the in-head water jacket 13 and flows out of the discharge port 13B.

When the pump discharge flow rate FP is 0, the water pump 18 is not working and the circulation of coolant in the coolant circuit 16 is sluggish. At this time, the differential pressure of the coolant in the in-head water jacket 13 and the coolant in the in-block water jacket 14 is substantially zero. Thus, the reed portion 33 is closed, and the circulation of the coolant in the in-head water jacket 13 and the coolant in the in-block water jacket 14 through the connection water passage 15 is stopped.

When the pump discharge flow rate FP is increased from 0, the coolant flowing from the water pump 18 through the in-head water jacket 13 and the radiator 17 and returning to the water pump 18 starts circulating. This causes the coolant to flow from the in-head water jacket 13 through the inter-bore water passages 21 into the in-block water jacket 14. However, the flow rate of coolant flowing through the inter-bore water passages 21, each of which has a small diameter, is limited. Thus, when the pump discharge flow rate FP is low, the block discharge flow rate FB is extremely smaller than the head discharge flow rate FH.

The pressure of coolant in each of the in-head water jacket 13 and the in-block water jacket 14 increases as the flow rate of the coolant passing therethrough increases. Thus, when the pump discharge flow rate FP is increased from zero, the differential pressure of the coolant in the in-head water jacket 13 and the coolant in the in-block water jacket 14 increases. When the pump discharge flow rate FP reaches a certain flow rate, the differential pressure works to push the reed portion 33 open. As a result, the coolant flows through the connection water passages 15 from the in-head water jacket 13 to the in-block water jacket 14. Accordingly, when the pump discharge flow rate FP exceeds the certain flow rate, the block discharge flow rate FB exponentially increases. In the following description, the lower limit value of the pump discharge flow rate FP at which the reed portion 33 is open is referred to as the valve-opening flow rate FO. The valve-opening flow rate FO corresponds to the lower limit value of the differential pressure of the coolant in the in-head water jacket 13 and the coolant in the in-block water jacket 14 at which the reed portion 33 is open.

Subsequently, the control of the pump discharge flow rate FP by the electronic control unit 19 will be described. The electronic control unit 19 refers to the operating states of the engine 10, such as the coolant temperature THW and the engine load KL, to regulate the drive voltage of the water pump 18, thereby controlling the pump discharge flow rate FP. The coolant temperature THW represents a detection value of the temperature of the coolant right after passing through the in-head water jacket 13 and flowing out of the discharge port 13B of the cylinder head 12.

During a warm-up operation from when the engine 10 is started to when the coolant temperature THW reaches a given warm-up complete temperature, the electronic control unit 19 drives and controls the water pump 18 within a range in which the pump discharge flow rate FP is less than the valve-opening flow rate FO such that the pump discharge flow rate FP increases as the coolant temperature THW increases. After the coolant temperature THW reaches the warm-up complete temperature, the electronic control unit 19 uses the engine load KL to drive and control the water pump 18 such that the pump discharge flow rate FP is less than the valve-opening flow rate FO during a low-load operation of the engine 10 and the pump discharge flow rate FP is greater than the valve-opening flow rate FO during a high-load operation of the engine 10.

During the warm-up operation prior to the completion of the warm-up of the engine 10, whereas it does not take time to increase in temperature at a portion of the top surface of the cylinder in the cylinder head 12, it takes time to increase in temperature at portions of the wall surfaces of the cylinder bores 20 in the cylinder block 11. In the present embodiment, when the warm-up of the engine 10 is not complete, the water pump 18 is driven and controlled such that the pump discharge flow rate FP is less than the valve-opening flow rate FO. At this time, the reed portion 33 is closed, and the flow of the coolant through the connection water passage 15 from the in-head water jacket 13 to the coolant in the in-block water jacket 14 is stopped. As a result, the flow of the coolant in the in-block water jacket 14 becomes sluggish, and the coolant flows intensively into the in-head water jacket 13. This facilitates the warm-up of the engine 10.

The water pump 18 is driven and controlled such that the pump discharge flow rate FP is less than the valve-opening flow rate FO during the low-load operation of the engine 10 subsequent to the completion of the warm-up and the pump discharge flow rate FP is greater than the valve-opening flow rate FO during the high-load operation.

More specifically, the pump discharge flow rate FP is controlled during the low-load operation subsequent to the warm-up such that the differential pressure of the coolant in the in-head water jacket 13 and the coolant in the in-block water jacket 14 is less than the lower limit value of that differential pressure at which the reed portion 33 is open. Thus, during the low-load operation, the coolant flows intensively into the in-head water jacket 13. This causes the portion of the top surface of the cylinder, which is likely to have a high temperature, to be mainly cooled. Accordingly, the engine 10 can be efficiently cooled using coolant with a small flow rate.

By contrast, the pump discharge flow rate FP is controlled during the high-load operation subsequent to the warm-up such that the differential pressure of the coolant in the in-head water jacket 13 and the coolant in the in-block water jacket 14 is greater than the lower limit value of that differential pressure at which the reed portion 33 is open. Thus, during the high-load operation, a large amount of coolant flows into the in-block water jacket 14 as well as the in-head water jacket 13. This causes both the cylinder head 12 and the cylinder block 11 to be sufficiently cooled.

During the low-load operation, the inter-bore portions of the cylinder block 11 that do not include the in-block water jacket 14 easily increase in temperature. Accordingly, coolant constantly flows through the inter-bore water passages 21 into the inter-bore portions of the cylinder block 11.

As described above, in the present embodiment, the engine 10 can be efficiently warmed up and cooled by individually regulating the flow rate of coolant in the in-head water jacket 13 and the flow rate of coolant in the in-block water jacket 14 (i.e., executing two-system cooling). Further, in the present embodiment, the two-system cooling can be achieved using the reed valve that is configured by the reed portion 33, which is arranged integrally with the head gasket 30, and that autonomously opens and closes in correspondence with the differential pressure of the coolant in the in-head water jacket 13 and the coolant in the in-block water jacket 14. Thus, as compared with a typical cooling structure using a flow rate control valve driven by an actuator, the two-system cooling can be achieved at lower costs.

The present embodiment has the following advantages.

(1) The reed valve opens and closes in correspondence with the differential pressure of coolant in the in-head water jacket 13 and coolant in the in-block water jacket 14. This switches between the state in which the circulation of coolant in the in-head water jacket 13 and the in-block water jacket 14 through the connection water passages 15 is allowed and the state in which the circulation of the coolant is stopped. Thus, the two-system cooling of the engine for individually regulating the flow rate of the coolant in the in-head water jacket 13 and the flow rate of the coolant in the in-block water jacket 14 can be performed. In the present embodiment, the two-system cooling of the engine 10 can be achieved by the reed valve configured by the reed portion 33, which is arranged integrally with the head gasket 30. This achieves the efficient engine cooling with using the two systems at lower costs.

(2) The reed valve functions as a one-way valve that allows the flow of coolant from the in-head water jacket 13 toward the in-block water jacket 14 in the connection water passages 15 and stops the flow of the coolant in the opposite direction. This allows the coolant to flow intensively into the in-head water jacket 13 and thus allows the engine 10 to be efficiently warmed up during the warm-up operation and the engine 10 to be efficiently cooled during the low-load operation. Subsequent to the completion of the warm-up, switching can be performed in correspondence with the opening and closing of the reed valve between the state in which coolant flows intensively into the in-head water jacket 13 and the state in which a large amount of coolant flows into both the in-head water jacket 13 and the in-block water jacket 14.

(3) Even when the flow of coolant in the connection water passages 15 is stopped by the reed valve, coolant constantly flows through the inter-bore water passages 21. This limits increases in temperature at the inter-bore portions, where the in-block water jacket 14 is not formed and heat is not easily dissipated.

(4) The electric water pump 18 that circulates coolant through the in-head water jacket 13 and the in-block water jacket 14 is provided to control the discharge amount of coolant in the water pump 18. The control allows the reed valve to open and close.

(5) When the warm-up of the engine 10 is not complete, the pump discharge flow rate FP is set to be less than the valve-opening flow rate FO to close the reed portion 33. This stops the flow of coolant from the in-head water jacket 13 toward the in-block water jacket 14 through the connection water passages 15. Thus, during the warm-up operation, the coolant flows intensively into the in-head water jacket 13. This facilitates the warm-up of the engine 10.

(6) During the low-load operation of the engine 10, the pump discharge flow rate FP is set to be less than the valve-opening flow rate FO. Thus, during the low-load operation, coolant is caused to flow intensively into the in-head water jacket 13. This allows the engine 10 to be efficiently cooled with coolant having a small flow rate.

The present embodiment may be modified as follows. The present embodiment and the following modifications can be combined as long as the combined modifications remain technically consistent with each other.

The pump discharge flow rate FP is controlled so as to switch the reed portion 33 to open and close using the coolant temperature THW and the engine load KL. Instead, the pump discharge flow rate FP may be controlled using only one of the coolant temperature THW and the engine load KL. Alternatively, the pump discharge flow rate FP may be controlled using the state quantities of the engine 10 other than the coolant temperature THW and the engine load KL, such as an engine rotation speed and an acceleration pedal depression degree.

The operation of the reed valve for the flow of coolant may be reversed from that of the present embodiment. That is, the reed valve may be configured to allow the flow of coolant from the in-block water jacket 14 toward the in-head water jacket 13 through the connection water passages 15 and stops the flow of the coolant in the opposite direction. In this case, switching can be performed between the state in which coolant intensively flows into the in-block water jacket 14 and the state in which a large amount of coolant flows into both the in-block water jacket 14 and the in-head water jacket 13. This allows the engine 10 to be cooled using the two systems.

Coolant constantly flows through the inter-bore water passages 21. The reed portion 33 may be arranged immediately above the openings of the inter-bore water passages 21 in the head gasket 30. In this case, in the same manner as the connection water passages 15, the flow of coolant in the inter-bore water passages 21 can be allowed and stopped.

Instead of the electric type, the water pump 18 may be of a mechanical type that operates as the engine 10 rotates. In this case, the pump discharge flow rate FP increases as the engine rotation speed increases. Thus, the reed portion 33 closes when the engine 10 rotates at a low speed and opens when the engine 10 rotates at a high speed.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. An engine cooling structure comprising:

a head gasket sitting between a bottom surface of a cylinder head and a top surface of a cylinder block;

an in-head water jacket in the cylinder head;

an in-block water jacket in the cylinder block;

a connection water passage for coolant that extends through the head gasket to connect the in-head water jacket and the in-block water jacket to each other; and a reed valve that opens and closes in correspondence with a differential pressure of coolant in the in-head water jacket and coolant in the in-block water jacket, wherein the reed valve includes a reed portion that is configured by cutting a groove into the head gasket and arranged integrally with a part of the head gasket corresponding to the connection water passage, the reed portion includes a first end and a second end, the first end being a portion of the head gasket where the groove is not cut out, the second end being a portion of the head gasket enclosed by the groove, and the second end is arranged so as to block an opening in the bottom surface of the cylinder head in the connection water passage.

2. The engine cooling structure according to claim 1, wherein the reed valve is configured to allow a flow of coolant from the in-head water jacket toward the in-block water jacket in the connection water passage and stop a flow of the coolant in an opposite direction.

3. The engine cooling structure according to claim 1, further comprising an inter-bore water passage arranged separately from the connection water passage, wherein the inter-bore water passage is configured to extend through a part between cylinder bores in the cylinder block and connect the in-head water jacket and the in-block water jacket to each other and is configured such that coolant is allowed to constantly circulate through the inter-bore water passage.

4. The engine cooling structure according to claim 1, further comprising an electric water pump that circulates coolant through the in-head water jacket and the in-block water jacket.

5. The engine cooling structure according to claim 4, further comprising a pump controller that controls a discharge flow rate of coolant in the water pump, wherein the pump controller is configured to control the discharge flow rate such that the differential pressure is less than a lower limit value of the differential pressure at which the reed valve is open when an engine load is low and the differential pressure is greater than the lower limit value when the engine load is high.

6. The engine cooling structure according to claim 5, wherein the pump controller is configured to control the discharge flow rate such that the differential pressure is less than the lower limit value when warm-up of the engine is not complete.

* * * * *